US009957777B2

(12) United States Patent
Xu

(10) Patent No.: US 9,957,777 B2
(45) Date of Patent: May 1, 2018

(54) FRAC PLUG AND METHODS OF USE

(71) Applicant: Baker Hughes Incorporated, Houston, TX (US)

(72) Inventor: YingQing Xu, Tomball, TX (US)

(73) Assignee: BAKER HUGHES, A GE COMPANY, LLC

( * ) Notice: Subject to any disclaimer, the term of this patent is extended or adjusted under 35 U.S.C. 154(b) by 233 days.

(21) Appl. No.: 15/042,756

(22) Filed: Feb. 12, 2016

(65) Prior Publication Data

US 2017/0234108 A1 Aug. 17, 2017

(51) Int. Cl.

| | |
|---|---|
| ***E21B 34/12*** | (2006.01) |
| ***E21B 33/12*** | (2006.01) |
| ***E21B 34/10*** | (2006.01) |
| ***E21B 33/129*** | (2006.01) |
| ***E21B 43/116*** | (2006.01) |
| ***E21B 43/26*** | (2006.01) |

(52) U.S. Cl.

CPC ..... *E21B 34/12* (2013.01); *E21B 33/12* (2013.01); *E21B 33/1293* (2013.01); *E21B 34/10* (2013.01); *E21B 43/116* (2013.01); *E21B 43/26* (2013.01)

(58) Field of Classification Search

CPC ..... E21B 33/12; E21B 2034/007; E21B 34/14

See application file for complete search history.

(56) References Cited

U.S. PATENT DOCUMENTS

| | | | | |
|---|---|---|---|---|
| 4,372,384 A * | 2/1983 | Kinney | E21B 43/04 | 166/278 |
| 4,635,716 A * | 1/1987 | Zunkel | E21B 33/1292 | 166/126 |
| 7,520,326 B1 * | 4/2009 | Hill | E21B 43/045 | 166/144 |

* cited by examiner

*Primary Examiner* — David J Bagnell
*Assistant Examiner* — Jonathan Malikasim
(74) *Attorney, Agent, or Firm* — Shawn Hunter

(57) ABSTRACT

A frac plug for use in a plug and perf arrangement to within a wellbore. The frac plug includes a central mandrel and locking portion which can be set within the wellbore. A bypass port is disposed through the central mandrel and is unblocked to fluid flow during setting of the plug assembly. Thereafter, the central mandrel is axially shifted within the set locking portion to block fluid communication across the frac plug.

16 Claims, 7 Drawing Sheets

FRAC PLUG AND METHODS OF USE

BACKGROUND OF THE INVENTION

1. Field of the Invention

The invention relates generally to the design of plugs during fracturing operations and the like in a wellbore.

2. Description of the Related Art

A popular method for stimulating and producing hydrocarbon fluid is known as a "plug and pen" operation. In a plug and perf operation, a fracturing plug ("frac plug"), setting tool and perforating guns are run into a wellbore on wireline. The frac plug is set within the wellbore by the setting tool. The perforating guns and setting tool are then released from the frac plug. The perforating guns and setting tool are moved away from the frac plug in the direction of the opening of the wellbore. Then the perforating guns are actuated to form perforations in the surrounding formation at discrete fracturing locations. The wireline, perforating guns and setting tool are then removed from the wellbore.

Next, a ball is circulated into the wellbore using water or other fluid and caused to land atop a ball seat of the frac plug creating a pressure barrier at the frac plug. Thereafter, fracturing fluid is flowed into the wellbore and into the perforations that were created by the perforating guns. A significant amount of water or other fluid is needed to circulate the ball or plug down through the flowbore of the tubing string and pressurize the flowbore behind it.

SUMMARY OF THE INVENTION

A plug and perf arrangement in accordance with the present invention includes a running string which carries one or more perforating guns, a plug setting tool and a fracturing plug ("frac plug") which is useful for closing off the wellbore to permit fracturing fluid into the wellbore above the plug. The frac plug can be set without the need for a ball or plug to be landed on the frac plug. An exemplary frac plug is described which includes a central mandrel that carries a locking portion that will lock the central mandrel within the surrounding wellbore or other tubular member. The locking portion can include a locking device in the form of a packer and/or one or more slip assemblies which are set by axial compression relative to the central mandrel. A setting tool is preferably used to compression-set the locking device. The central mandrel defines a central axial flowbore with a fluid flow blockage located within proximate the upper end of the mandrel. The central mandrel also features at least one bypass port which is disposed through the mandrel and permits fluid communication between the central flowbore and the surrounding annulus.

In operation, a plug and perf arrangement containing a frac plug is run into the wellbore, preferably using wireline, until a position is reached where the frac plug is to be set. The setting tool is actuated to set the frac plug within the wellbore. As the setting tool sets the frac plug, the bypass port is opened which permits fluid communication with the central flowbore. Pressurizing the annulus will shift the central mandrel within the locking portion to close off fluid communication across the frac plug.

BRIEF DESCRIPTION OF THE DRAWINGS

For a thorough understanding of the present invention, reference is made to the following detailed description of the preferred embodiments, taken in conjunction with the accompanying drawings, wherein like reference numerals designate like or similar elements throughout the several figures of the drawings and wherein.

DETAILED DESCRIPTION OF THE PREFERRED EMBODIMENTS

Figure 1:
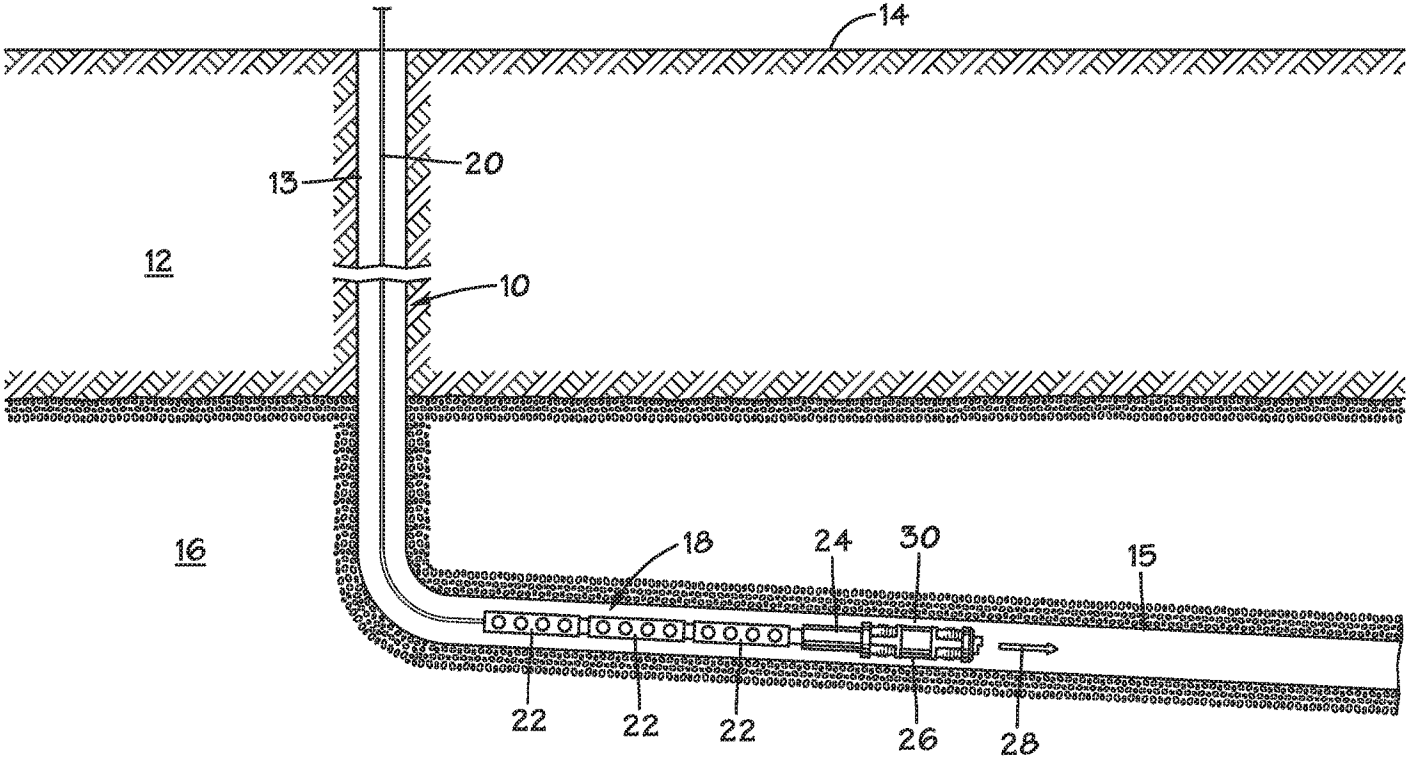
FIG. 1 is a side, cross-sectional view of an exemplary wellbore having a plug and perf arrangement being run into it in accordance with the present invention.

FIG. 1 illustrates an exemplary wellbore 10 which has been drilled through the earth 12 from the surface 14 down to a hydrocarbon-bearing formation 16. In the depicted embodiment, the wellbore 10 has a generally vertical portion 13 and a generally horizontal, or deviated portion 15. In the described scenario, it is desired to stimulate the formation 14 by first perforating the formation 16 and then injecting a fracturing fluid or other stimulation fluid into the perforations.

A plug and pert (plug and perforation) arrangement 18 is shown disposed within the wellbore 10 in FIG. 1. The plug and perf arrangement 18 generally includes a wireline running string 20, a number of perforating guns 22, a plug setting tool 24 and frac plug 26. The plug and pert arrangement 18 is shown being run into the wellbore 10 from the surface 14 in the direction of arrow 28 in FIG. 1. An annulus 30 is defined radially between the frac plug 26 and the inner wall of the wellbore 10. The plug setting tool 24 may be any of a variety of tools which are known and used to set compression-set packers or slip assemblies within a wellbore or other tubular member. Typically, such setting tools are hydraulically-actuated and, as FIGS. 4-7 illustrate, feature an inner sleeve 27, which will be secured to the central mandrel of a plug device, and an outer sleeve 29, which is moved axially with respect to the inner sleeve to exert axial pressure upon the slips or packer which radially surrounds the central mandrel of an affixed plug device.

Figure 2:
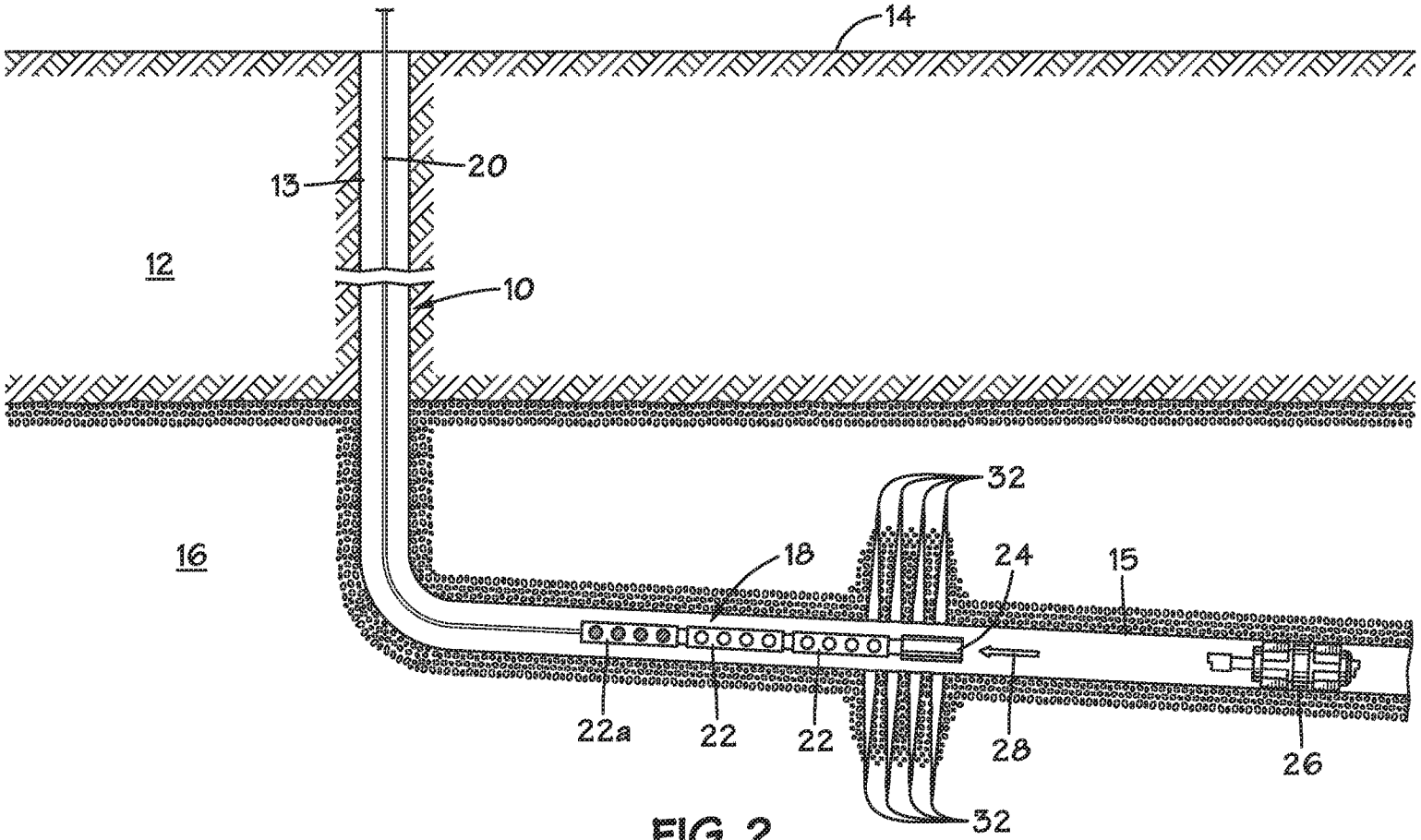
FIG. 2 is a side, cross-sectional view of the wellbore and plug and perf arrangement shown in FIG. 1, now with the frac plug having been set.

FIG. 2 depicts the wellbore 10 and plug and perf arrangement 18 at a subsequent stage of the operation wherein the frac plug 26 has been set within the wellbore 10 by the setting tool 24. The setting operation will be described in greater detail with regard to FIGS. 4-7. In FIG. 2, the setting tool 24 has been released from the frac plug 26 and the running string 20 is moving the perforating guns 22 and setting tool 24 away from the frac plug 26 in the direction indicated by the arrow 30. One perforating gun 22*a* has been detonated to create a first set of perforations 32.

Figure 3:
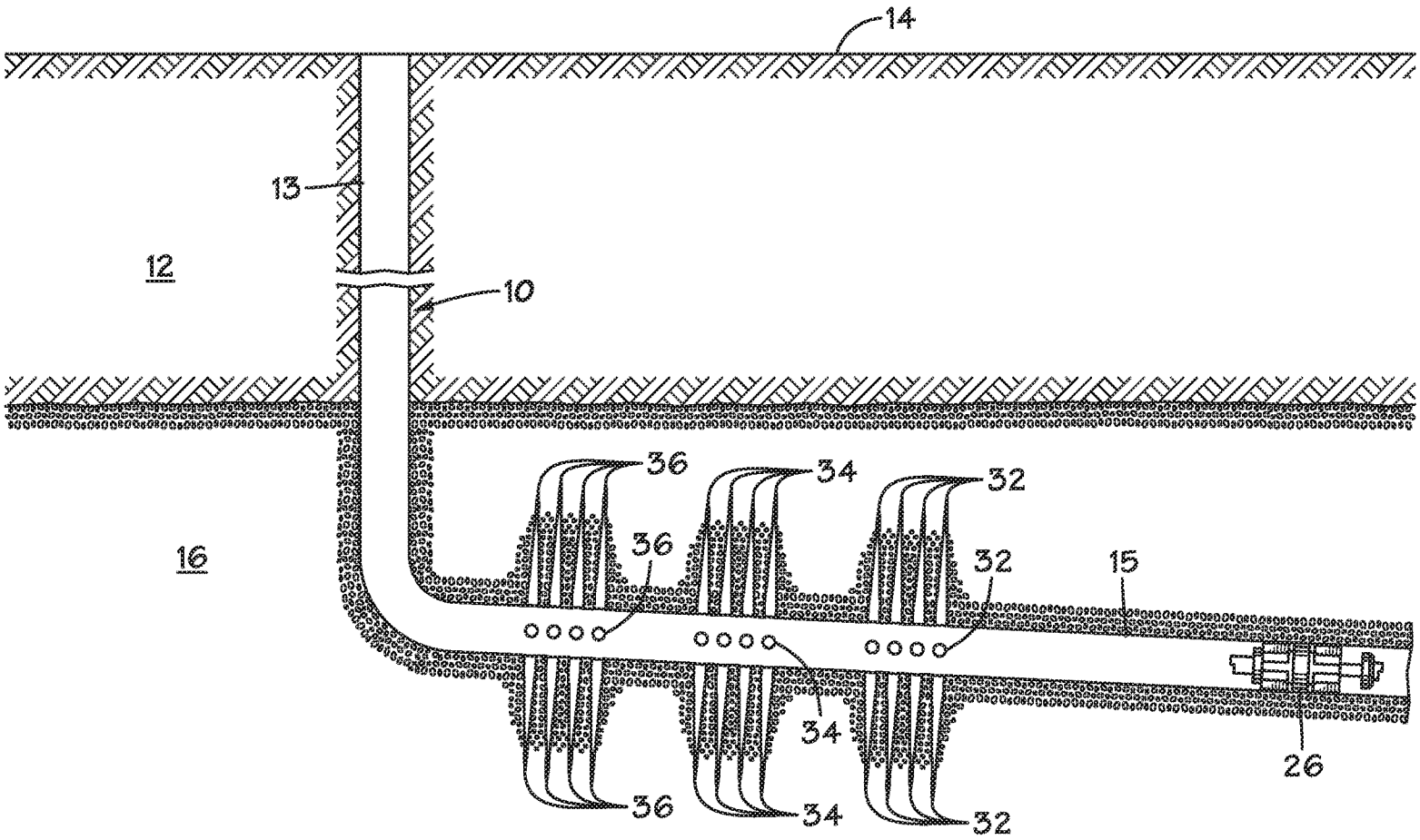
FIG. 3 is a side, cross-sectional view of the wellbore and plug and perf arrangement of FIGS. 1-2, now with the setting tool released from the frac plug and the running string being withdrawn.

In FIG. 3, the running string 20, perforating guns 22 and setting tool 24 have been removed from the wellbore 10. Additional perforations 34, 36 have been formed by the remaining perforating guns 22 prior to their removal. The wellbore 10 can now be pressurized with fluid to close the frac plug 26 so that fluid flow across the frac plug 26 is not possible. Thereafter, fracturing fluid can be pumped down into the wellbore 10 and, under pressure, will enter the perforations 32, 34, 36.

The structure and operation of the frac plug 26 is better appreciated with reference to FIGS. 4-7. Frac plug 26 includes a central mandrel 38 which defines a flowbore 40 along its length. The upper end of the central mandrel 38 has a radially enlarged portion 42 with a shaped axial end 44 which is designed to assist contact by milling tool (not shown) at a later stage wherein it would be desired to mill away the frac plug 26. A flow blockage 46 is formed within the upper end of the flowbore 40. The lower end of the central mandrel 38 also features a radially enlarged portion 48 preferably also having a shaped axial end 50.

A locking portion 52 is carried on the central mandrel 38 of the frac plug 26. In the depicted embodiment, the locking portion 52 includes locking devices in the form of a compression-set elastomeric packer element 54 and two compression-set slip assemblies 56. It is noted that the locking portion 52 may have only a single locking device (i.e., a single packer or slip) or additional locking devices. Each of the slip assemblies 56 includes a slip housing 58 and a plurality of toothed anchoring slips 60 which can move radially outwardly within the slip housing 58 during setting. The locking portion 52 is also preferably provided with upper and lower end collars 62, 64, respectively, which are slidably disposed upon the central mandrel 38.

It is noted that the central mandrel 38 is perforated with at least one lateral bypass flow port 66. Bypass flow port 66 is disposed through an upper portion of the central mandrel 38, preferably radially within the upper slip assembly 56 and axially below the flow blockage 46. The bypass flow port 66 allows fluid communication between the flowbore 40 of the central mandrel 38 and an area radially surrounding the central mandrel 38. When in the run-in position shown in FIG. 2, the bypass flow port 66 closed off to fluid flow by the radially surrounding locking portion 52.

Figure 4:
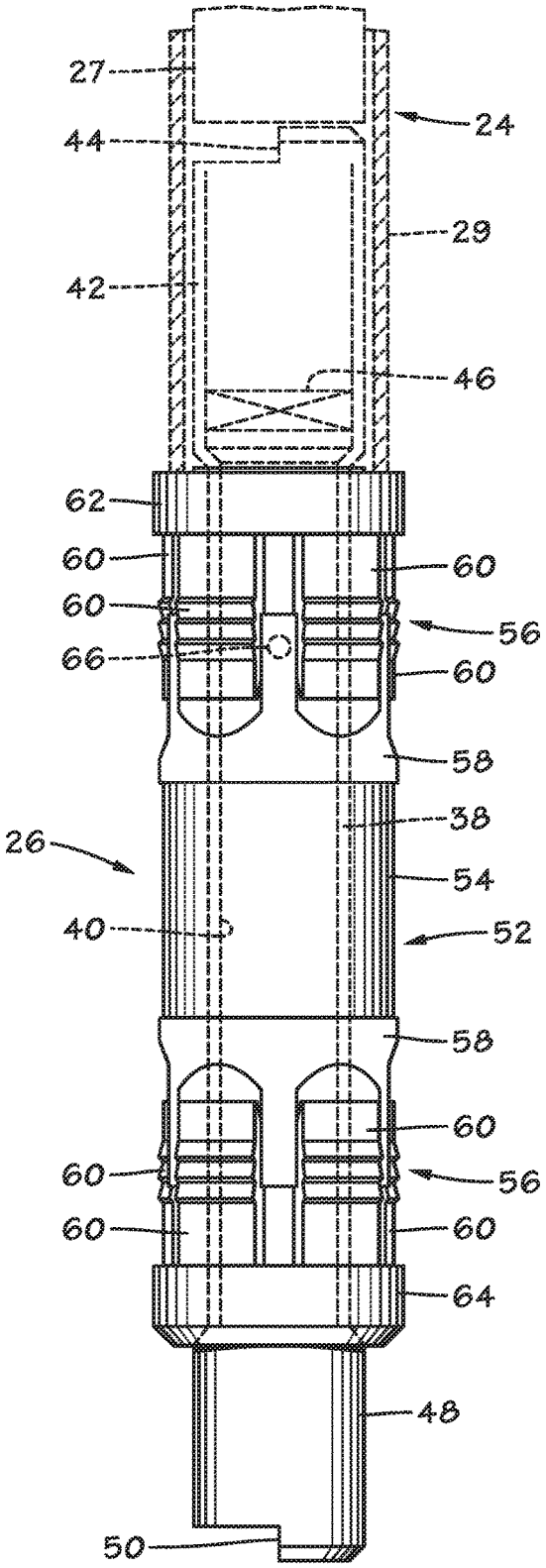
FIG. 4 is a side, cross-sectional view of an exemplary frac plug in accordance with the present invention during a run-in position.
Figure 5:
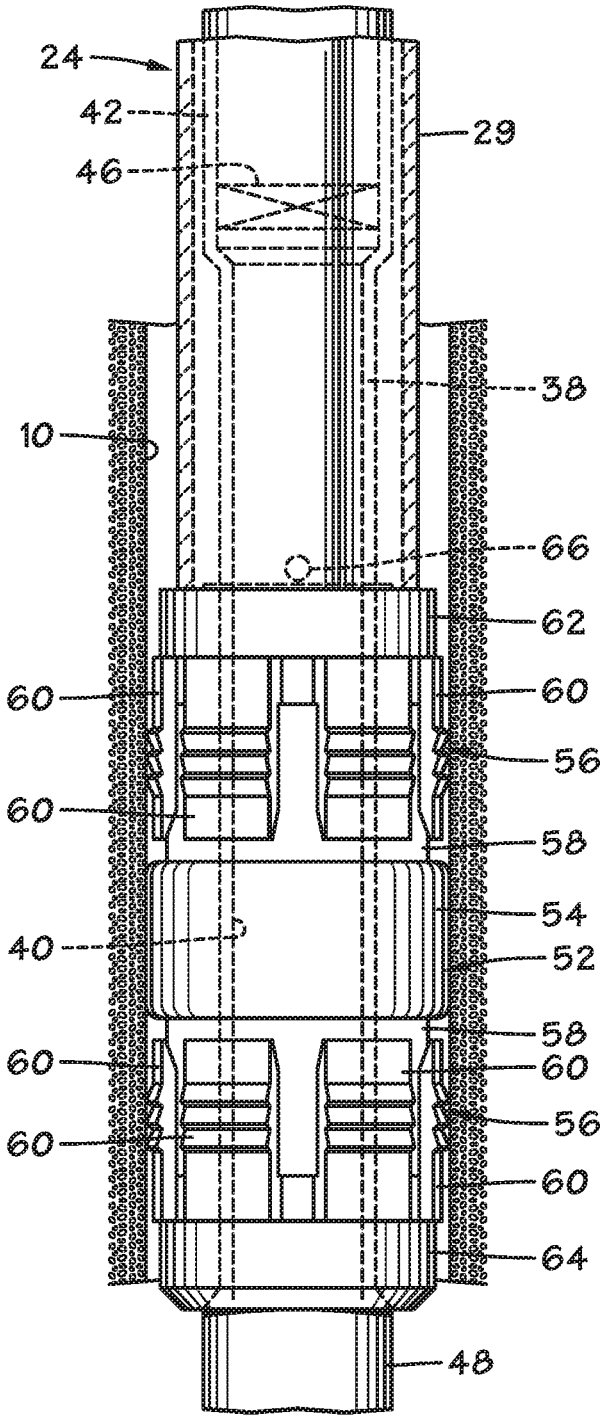
FIG. 5 is a side, cross-sectional view of the frac plug of FIG. 4 during setting.
Figure 6:
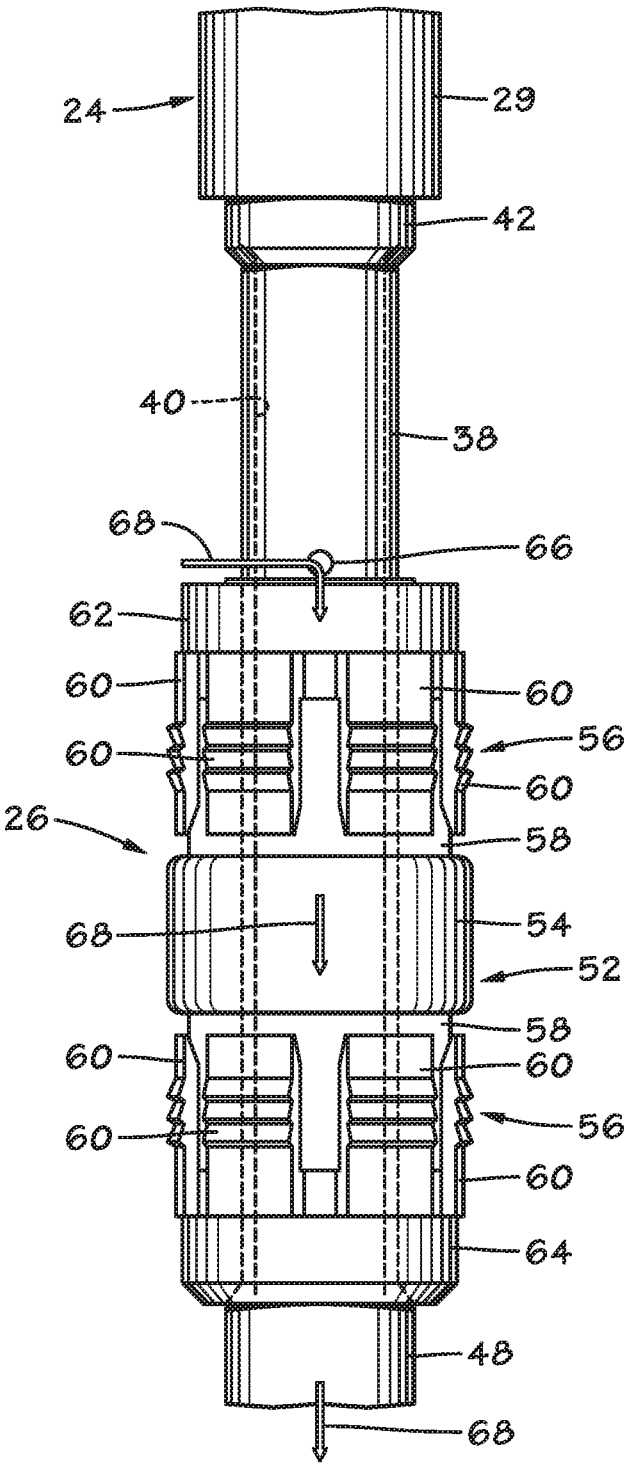
FIG. 6 is a side, cross-sectional view of the frac plug of FIG. 4-5, now in a subsequent set position.

During run-in, the frac plug 26 is in the initial configuration shown in FIG. 4. Next, the plug setting tool 24 is actuated to cause the outer sleeve 29 to move axially downwardly with respect to the inner sleeve 27, as depicted in FIG. 5. This downward movement sets the frac plug 26 by axially compressing the packer element 54 and the slip assemblies 56. As is known, axial compression causes the packer element 54 to protrude radially outwardly and into sealing contact with the wall of the wellbore 10 (see FIG. 5). Axial compression also causes the slip elements 60 of the slip assemblies 56 to move radially outwardly into engaging contact with the wellbore 10 and anchor or lock the frac plug 26 in place within the wellbore 10. This axial compression also moves the locking portion 52 from blocking the bypass port 66.

Downward movement of the outer sleeve 29 also moves end collar 62 axially downwardly upon the central mandrel 38. As the setting tool 24 is released from the frac plug 26, the outer sleeve 29 unblocks the bypass port 66, thereby permitting fluid communication with the central flowbore 40, as illustrated by the arrows 68 in FIG. 6. Fluid can now be flowed across the frac plug 26. The inventor has recognized that fluid communication across the frac plug 26 is useful at this point. Fluid would need to flow through the frac plug 26 after setting as a contingency for a scenario where the perforation guns do not fire as intended and operators need to pull them out of the hole. A flow path through the frac plug is needed to remove the guns and then pump the perforation guns back down hole.

Figure 7:
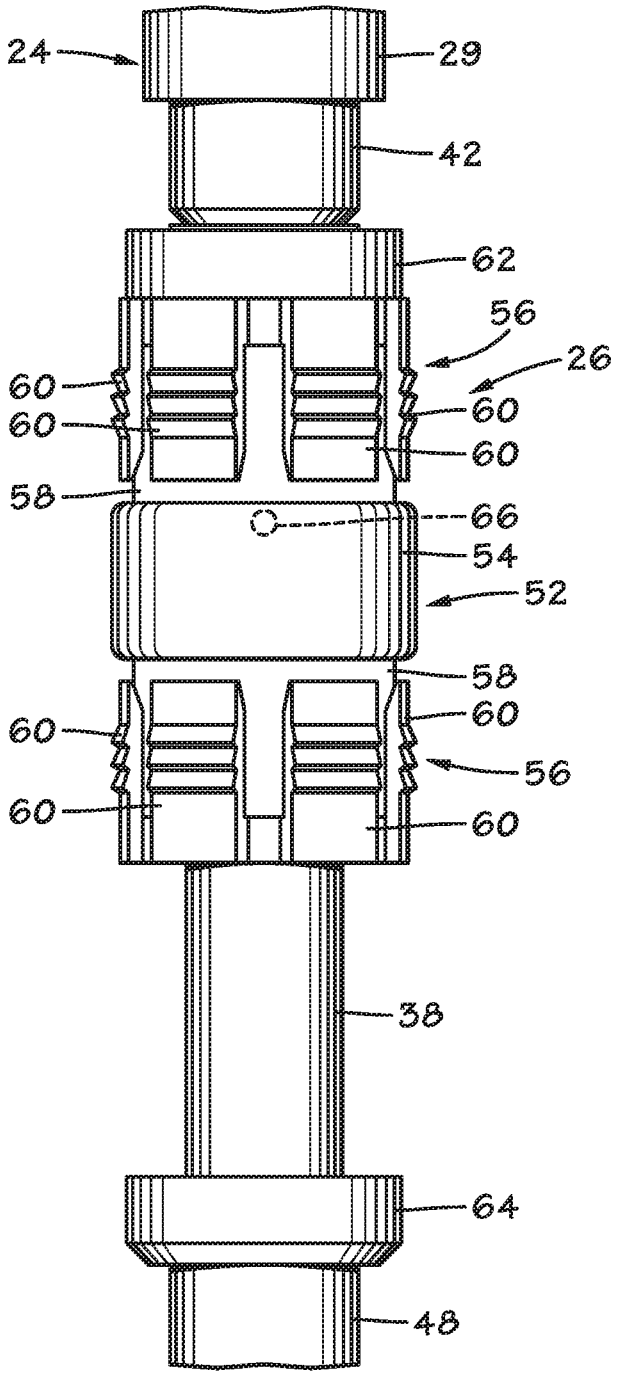
FIG. 7 is a side, cross-sectional view of the frac plug of FIGS. 4-6 now a subsequent position which blocks fluid communication across the plug.

When it is desired to close the frac plug 26 to block fluid communication across the frac plug 26, fluid pressure is increased from surface 14 and acts upon the radially enlarged end portion 42 and flow blockage 46 of the central mandrel 38 to cause the central mandrel 38 to shift axially downwardly within the locking portion 52 to the position shown in FIG. 7. In this position, the bypass port 66 is blocked by the packer element 54. The wellbore 10 can now be pressurized and have fracturing fluid flowed into the perforations 32, 34, 36, as described previously.

Those of skill in the art will recognize that numerous modifications and changes may be made to the exemplary designs and embodiments described herein and that the invention is limited only by the claims that follow and any equivalents thereof.

What is claimed is:

1. A frac plug for use in closing off a portion of a wellbore tubular to fluid flow, the frac plug comprising:

a central mandrel defining a central flowbore along its length;

a locking portion radially surrounding the central mandrel, the locking portion having a locking device that is moveable between unset and set positions by axial compression of the locking device upon the central mandrel;

a bypass port disposed through the central mandrel to allow fluid communication with the central flowbore, the bypass port being open to fluid flow when the locking portion is in the set position; and wherein the central mandrel is axially shiftable within the locking portion once it is in the set position to close the bypass port to fluid flow and preclude fluid communication across the frac plug.

2. The frac plug of claim 1 wherein the locking device of the locking portion comprises an elastomeric packer element.

3. The frac plug of claim 1 wherein the locking device of the locking portion comprises a slip assembly.

4. The frac plug of claim 1 wherein the locking portion is compression set by a setting tool.

5. The frac plug of claim 1 wherein the flowbore of the central mandrel further includes a flow blockage within.

6. A plug and perf arrangement for injection of fracturing fluid within a portion of a wellbore, the plug and perf arrangement comprising:

a running string that is disposed within the wellbore from a surface location;

a setting tool for compression-setting a frac plug within the tubing string;

a frac plug releasably secured to the setting tool, the frac plug having:

a) a central mandrel defining a central flowbore along its length;

b) a locking portion radially surrounding the central mandrel, the locking portion having a locking device that is moveable between unset and set positions by axial compression of the locking device upon the central mandrel;

c) a bypass port disposed through the central mandrel to allow fluid communication with the central flowbore, the bypass port being open to fluid flow when the locking portion is in the set position; and d) wherein the central mandrel is axially shiftable within the locking portion once it is in the set position to close the bypass port to fluid flow and preclude fluid communication across the frac plug.

7. The plug and perf arrangement of claim 6 wherein the locking device of the locking portion comprises an elastomeric packer element.

8. The fluid injection arrangement of claim 6 wherein the locking device of the locking portion comprises a slip assembly.

9. The fluid injection arrangement of claim 6 further comprising a perforating gun to form perforations within a formation radially surrounding the portion of wellbore.

10. A method of setting a frac plug within a wellbore, the method comprising the steps of:

disposing a frac plug within a wellbore to a location wherein it is desired to close off fluid flow, the frac plug having a central mandrel and a locking portion which radially surrounds the central mandrel;

setting the locking portion of the frac plug within the wellbore to lock the frac plug in place;

as the locking portion of the frac plug is being set, opening a bypass port in the central mandrel to permit fluid communication across the frac plug;

pressurizing the wellbore above the frac plug to create fluid pressure upon the central mandrel; and shifting the central mandrel within the locking portion to close the bypass port and preclude fluid communication across the frac plug.

11. The method of claim 10 wherein the step of setting the locking portion further comprises setting an elastomeric packer.

12. The method of claim 10 wherein the step of setting the locking portion further comprises setting a slip assembly.

13. The method of claim 10 wherein the step of setting the locking portion further comprises axially compressing the locking portion upon the central mandrel.

14. The method of claim 10 wherein the step of opening the bypass port in the central mandrel is performed as the locking portion is set by unblocking the bypass port.

15. The method of claim 10 wherein the step of shifting the central mandrel within the locking portion to close the bypass port further comprises blocking the bypass port with the locking portion.

16. The method of claim 10 wherein the step of disposing the frac plug within a wellbore further comprises running the frac plug in on a wireline running string.

* * * * *